US008616925B2

(12) United States Patent
Kobayashi et al.

(10) Patent No.: US 8,616,925 B2
(45) Date of Patent: Dec. 31, 2013

(54) MULTI-CONTACT TERMINAL FITTING

(75) Inventors: Yutaka Kobayashi, Yokkaichi (JP); Hikaru Ito, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 29 days.

(21) Appl. No.: 13/357,084

(22) Filed: Jan. 24, 2012

(65) Prior Publication Data

US 2012/0202391 A1 Aug. 9, 2012

(30) Foreign Application Priority Data

Feb. 4, 2011 (JP) ..... 2011-023124

(51) Int. Cl.
*H01R 13/11* (2006.01)

(52) U.S. Cl.
USPC ..... 439/857; 439/845

(58) Field of Classification Search
USPC ..... 439/357, 856, 845
See application file for complete search history.

(56) References Cited

U.S. PATENT DOCUMENTS

| | | | | |
|---|---|---|---|---|
| 5,938,485 | A * | 8/1999 | Hotea et al. | 439/839 |
| 6,776,635 | B2 * | 8/2004 | Blanchfield et al. | 439/181 |
| 2005/0118891 | A1 | 6/2005 | Chen | |

FOREIGN PATENT DOCUMENTS

| | | |
|---|---|---|
| EP | 0700122 | 3/1996 |
| EP | 0833409 | 4/1998 |
| FR | 2769413 | 4/1999 |
| JP | 2005-166300 | 6/2005 |
| JP | 2007-157525 | 6/2007 |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A multi-contact terminal fitting (T) has a plurality of resilient contact pieces (40) that extend from a rectangular tubular base (25) and can be brought into contact with an outer peripheral surface of a flat plate-shaped tab (11). The resilient contact pieces (40) extending from parts of the base (25) that have relatively high rigidity are narrow and those extending from less rigid parts of the base (25) are wider.

13 Claims, 12 Drawing Sheets

MULTI-CONTACT TERMINAL FITTING

BACKGROUND OF THE INVENTION

1. Field of the Invention

The invention relates to a multi-contact terminal fitting.

2. Description of the Related Art

A multi-contact terminal fitting contacts plural points on a mating terminal. Thus, a multi-contact terminal fitting can reduce contact resistance and can suppress the amount of heat generation by being brought into contact at a multitude of points. Accordingly, a terminal fitting of this type would be well suited for a large-current connection terminal in an electric vehicle and the like.

Japanese Unexamined Patent Publication No. 2007-157525 discloses a multi-contact terminal fitting with plural resilient contact pieces that are brought into contact with the outer peripheral surface of a bar-like round pin having a circular cross section. The resilient contact pieces extend from an end edge of a cylindrical base. The round pin for this multi-contact terminal fitting is formed by cutting work, and hence this multi-contact terminal fitting has undesirably high production costs.

Japanese Unexamined Patent Publication No. 2005-166300 also discloses a multi-contact terminal fitting with plural resilient contact pieces that are brought into contact with the outer peripheral surface of a tab in the form of a flat plate. The resilient contact pieces are formed on a main portion in the form of a rectangular tube into which the tab is inserted, and both ends thereof are supported on a main portion. This terminal fitting can be produced less expensively than the terminal fitting of Japanese Unexamined Patent Publication No. 2005-166300 since the tab can be formed by pressing work. However, the main portion formed with the resilient contact pieces has a rectangular tubular shape that conforms to the shape of the tab in this terminal fitting. Corners of the rectangular tube tend to be more rigid than other parts. Thus, the contact pressures that act on the tab vary in accordance with the rigidity of the portion of the rectangular tube from which the contact pieces extend. Areas that have high contact resistance cause local heat generation.

The invention was completed in view of the above situation and an object thereof is to provide a multi-contact terminal fitting with plural resilient contact pieces that can be brought into contact with the outer peripheral surface of a flat plate-shaped tab of at a mating connector so that contact pressures of the plural resilient contact pieces are substantially equal.

SUMMARY OF THE INVENTION

The invention relates to a multi-contact terminal fitting with plural resilient contact pieces that can be brought into contact with the outer peripheral surface of a tab of a mating terminal fitting. The resilient contact pieces extend from a base and include first resilient contact pieces that extend from a more rigid part of the base and second resilient contact pieces that extend from a less rigid part of the base. The first resilient contact pieces are narrower than the second resilient contact pieces. Accordingly, the rigidity of the narrow first resilient contact pieces that extend from the highly rigid part of the base is relatively low and the rigidity of the wider second resilient contact pieces that extend from the less rigid parts of the base is relatively high. Therefore contact pressures acting from the plurality of resilient contact pieces on the tab can be made equal.

The base preferably is folded into a rectangular or polygonal tube and end edges are locked together to prevent opening.

Accordingly, the contact pressures of the resilient contact pieces will not be reduced by an opening of the base.

A cover may be provided for at least partly covering and protecting the resilient contact pieces. The tab may be inserted into the female terminal fitting while being held in contact with one or more inner walls of the cover.

The resilient contact pieces may be cantilevered from the base. A cover support may be located outwardly of the free ends of the resilient contact pieces and may be held in contact with the inner side of the cover. The cover support prevents the cover from contacting the resilient contact pieces.

A coupling may connect the cover support to the base. The cover support may have substantially the same cross-sectional shape as the base and a dimension of the cover support in forward and backward directions may be smaller than that of the base.

A most inwardly projecting part of the resilient contact piece may define a contact to be brought into contact with the tab.

The contact of the resilient contact piece may be closer to a vertical center of the coupling than the lateral edge of the coupling when the resilient contact piece is in a natural state.

A tip of the resilient contact piece may stay at a position more inward than a ceiling plate or a bottom plate of the base when the resilient contact piece is in a natural state and/or may not project from the ceiling plate or the bottom plate even if the resilient contact piece is deformed resiliently by contact with the tab.

A difference between the base ends and the free ends of the first resilient contact pieces may be larger than a difference between the base ends and the free ends of the second resilient contact pieces.

Free ends of the resilient contact pieces may be narrower than the base ends, and the widths preferably are narrowed substantially at a fixed rate from the base ends toward the free ends.

These and other features of the invention will become more apparent upon reading the following detailed description of a preferred embodiment and accompanying drawings.

DETAILED DESCRIPTION OF THE PREFERRED EMBODIMENTS

Figure 1:
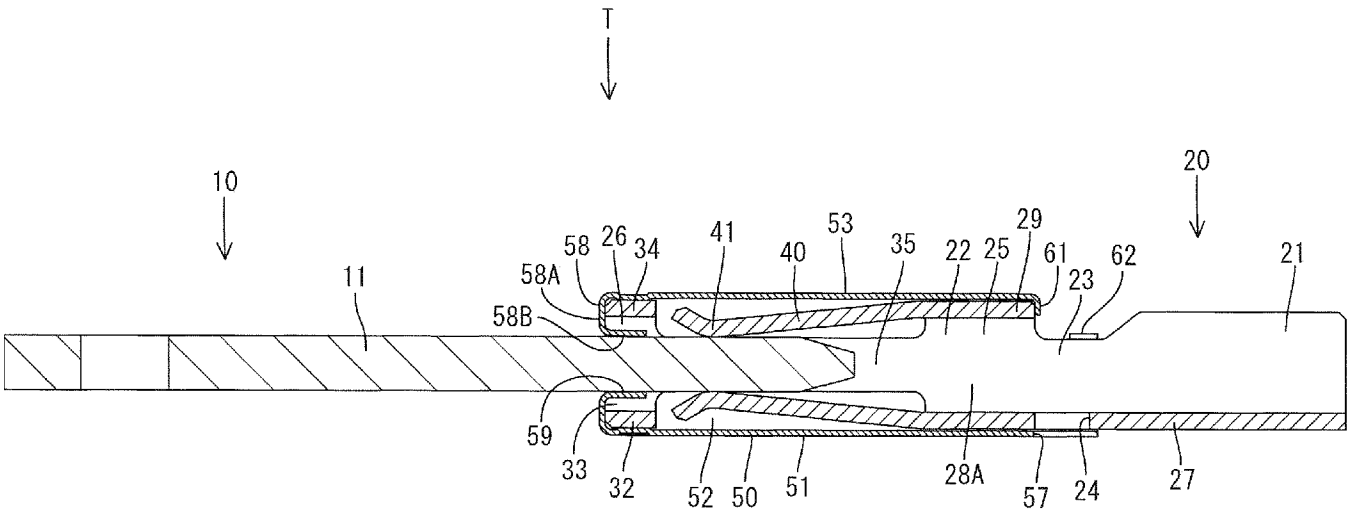
FIG. 1 is a section of an embodiment of the multi-contact terminal fitting.
Figure 2:
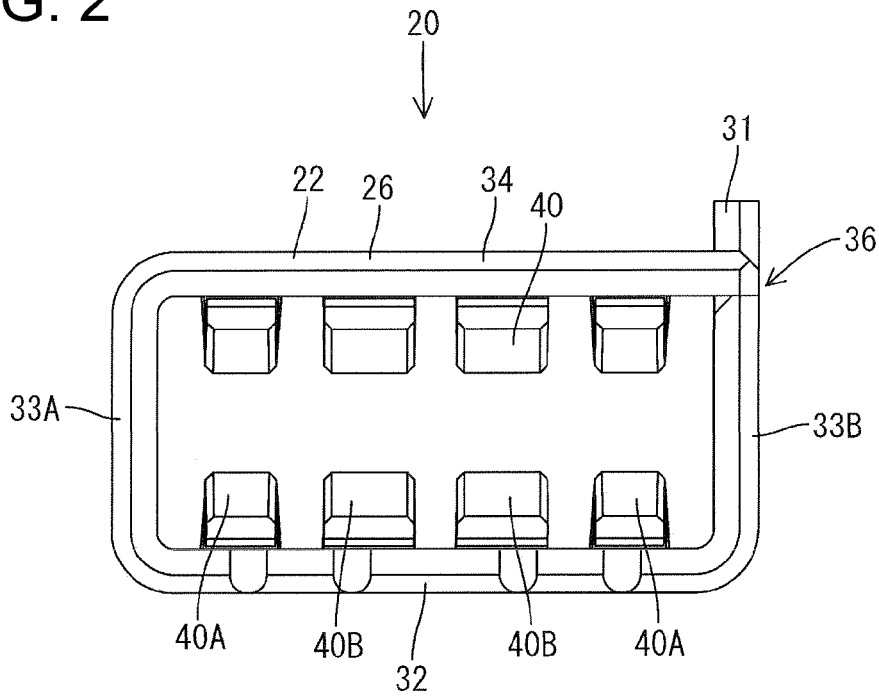
FIG. 2 is a front view of a female terminal fitting.

A multi contact terminal fitting is identified by the letter T in FIGS. 1 to 13 and is suitable for a large current power supply line of an electric vehicle, a hybrid vehicle or the like. As shown in FIG. 1, the multi-contact terminal fitting T includes a male terminal fitting 10 and a female terminal fitting 20 connectable to each other. In the following description, a connecting direction with a mating member is a forward direction, and directions toward upper and lower sides in FIG. 1 are respectively upward and downward directions for respective constituent members.

The male terminal fitting 10 is formed by press-working, bending, folding and/or embossing a conductive metal plate having excellent electrical conductivity such as copper alloy. One end of the male terminal fitting 10 is to be connected to an unillustrated wire and the tab 11 is provided at the other end. A leading end portion of the tab 11 is squeezed or pressed between upper and lower molds of a pressing machine so that thickness (vertical dimension) is reduced gradually or stepwise toward the tip.

The female terminal fitting 20 is formed by press-working, bending, folding and/or embossing a conductive metal plate having excellent electrical conductivity such as copper alloy. The female terminal fitting 20 has a wire connecting portion 21 at a rear end for connection to an unillustrated wire, a main portion 22 at the front end for connection to the tab 11 of the male terminal fitting 10 and a coupling 23 extending therebetween. Further, a cover 50 is mounted on the female terminal fitting 20 for at least partly covering the resilient contact pieces 40.

A substantially rectangular lance hole 24 is formed at a widthwise intermediate position in a bottom plate 27 of the coupling 23 for retaining purposes when the female terminal fitting 20 is in a female housing (not shown).

The main portion 22 includes a base 25 at a rear end, a cover support 26 at a front end and the resilient contact pieces 40 between the base 25 and the cover 26.

The base 25 is folded into a substantially flat rectangular tube and end edges thereof in a folding direction are locked together to prevent opening. The base 25 includes the bottom plate 27, first and second side plates 28A, 28B standing up at opposite sides of the bottom plate 27, and a ceiling plate 29. The ceiling plate 29 is bent at the upper end of the first side plate 28A to extend substantially parallel to the bottom plate 27 and engages an upper end of the second side plate 28B.

Figure 3:
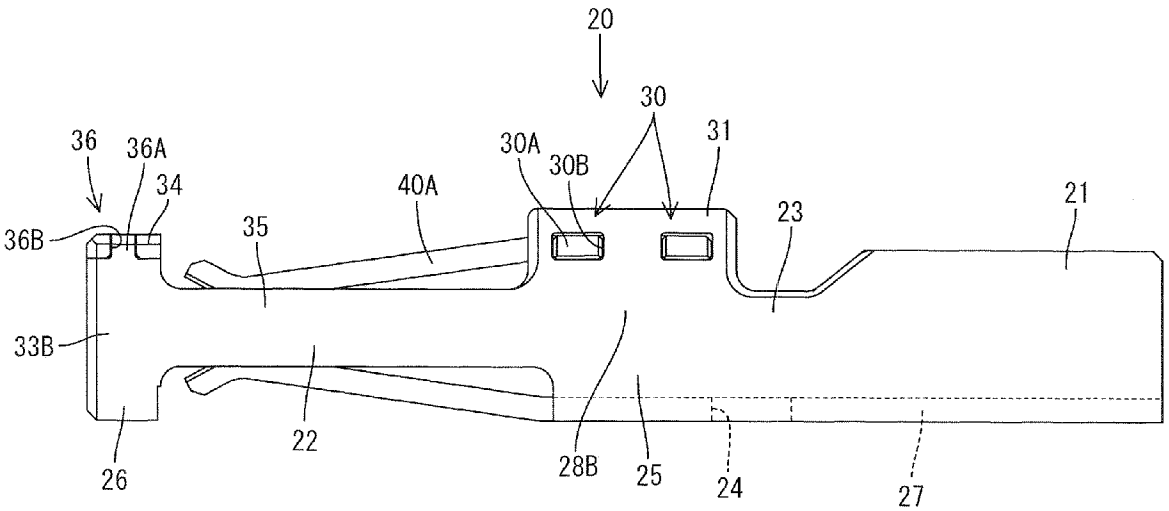
FIG. 3 is a side view of the female terminal fitting.
Figure 4:
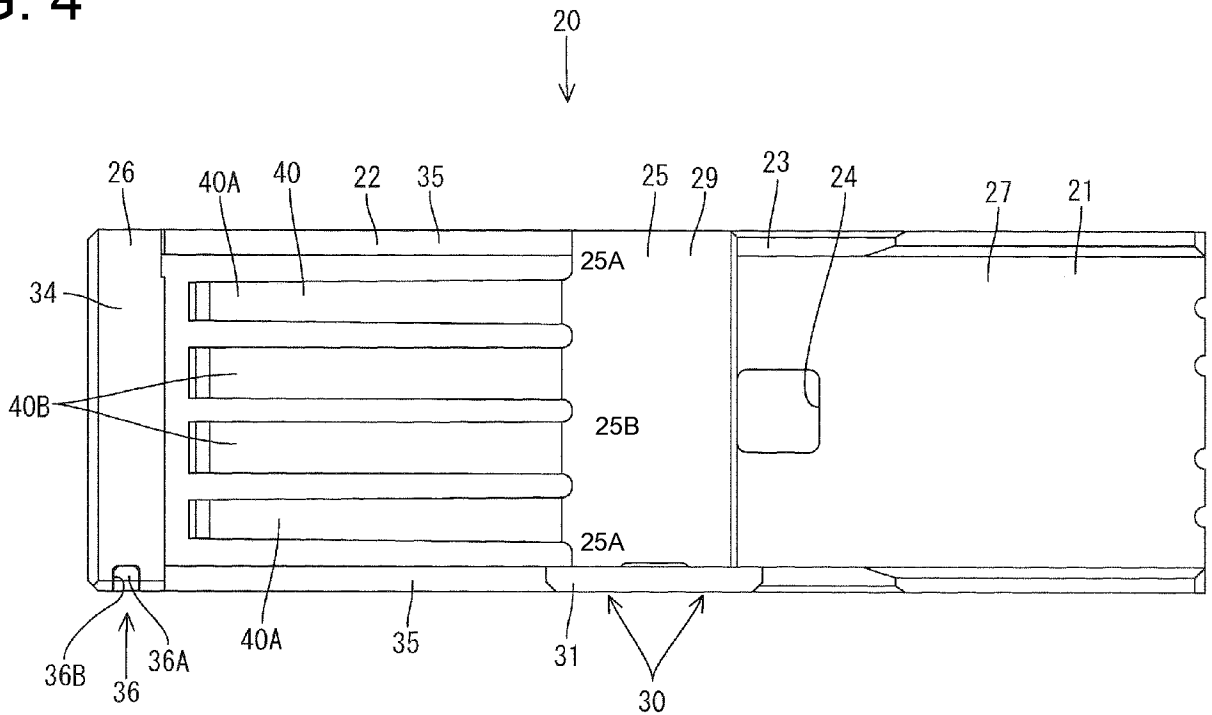
FIG. 4 is a plan view of the female terminal fitting.
Figure 5:
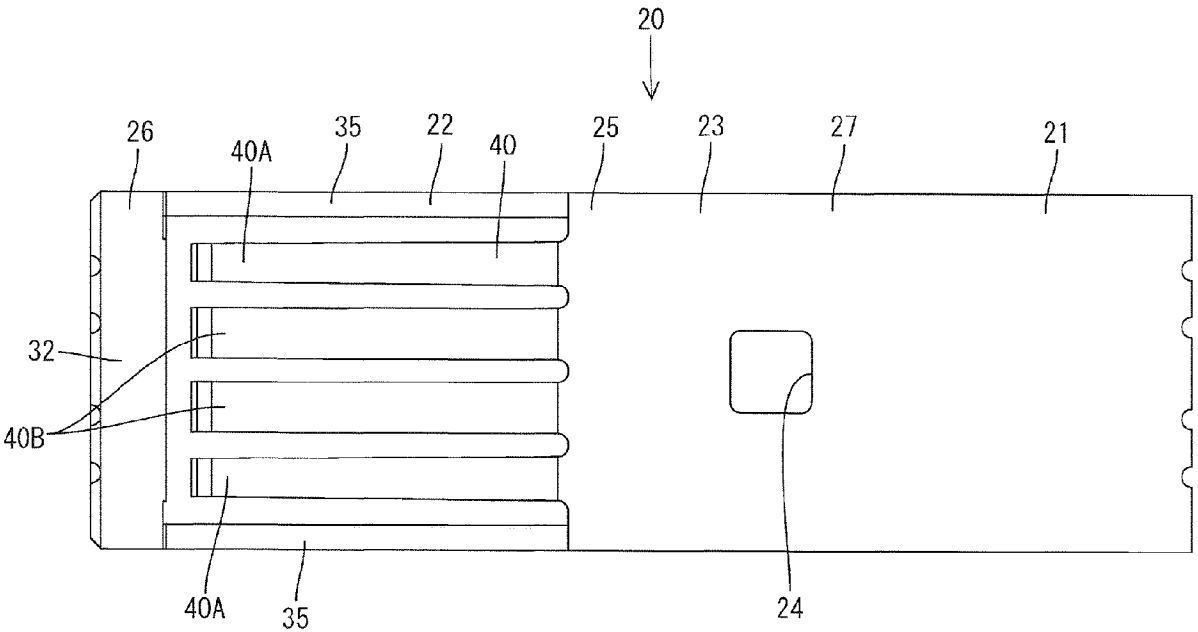
FIG. 5 is a bottom view of the female terminal fitting.

The base 25 includes locks 30 for locking the end edges of the base 25 in the folding direction to prevent opening (see FIG. 3). The locks 30 are provided positions spaced apart in forward and backward directions. Each lock 30 has a locking projection 30A formed on the ceiling plate 29 and a locking recess 30B formed in the second side plate 28B. The locking projection 30A is substantially rectangular and projects from an end edge of the ceiling plate 29 in a direction substantially parallel with the plate surface of the ceiling plate 29. The locking recess 30B is substantially rectangular and penetrates through the upper end of the second side plate 28B in a plate thickness direction. The locking projections 30A are fit into the respective locking recesses 30B by bringing the end edge of the ceiling plate 29 into contact with the plate surface of the second side plate 28B. The locking projections 30A are pressed against the locking recesses 30B from outside by hitting, crimping or deforming the outer end edge of the second side plate 28B. This engagement of the locking projections 30A and the locking recesses 30B prevents the end edges of the base 25 from opening.

The upper end of the second side plate 28B projects up to define a stabilizer 31. The stabilizer 31 prevents erroneous insertion (vertically inverted insertion) of the female terminal fitting 20 into the unillustrated female housing and stabilizes an insertion posture of the female terminal fitting 20.

Similar to the base 25, the cover support 26 is folded into a substantially flat rectangular tube and end edges thereof are locked to each other to prevent opening. The cover support 26 has substantially the same cross-sectional shape as the base 25 (excluding the stabilizer 31), and a dimension thereof in forward and backward directions is smaller than that of the base 25. The cover support 26 includes a front bottom plate 32, first and second front side plates 33A, 33B stand up from the opposite sides of the front bottom plate 32, and a front ceiling plate 34 is bent at the upper end of the first front side plate 33A. The ceiling plate 34 extends substantially parallel to the front bottom plate 32 and engages an upper end portion of the second front side plate 33B (see FIG. 2).

A coupling 35 couples the side plates 28A, 28B of the base 25 and the front side plates 33A, 33B of the cover support 26, and opposite end portions thereof are connected to vertical intermediate parts of the side plates 28A, 28B and the front side plates 33A, 33B. Note that a vertical dimension of the coupling 35 is about one third of those of the base 25 and the cover support 26.

The cover support 26 includes a front lock 36 at an intermediate position of the cover support 26 in forward and backward directions for locking the end edges of the cover support 26 in a folding direction. The front lock 36 has a front locking recess 36B formed in the end edge of the front ceiling plate 34 and a locking projection 36A extending from the upper end edge of the second front side plate 33B (see FIGS. 3 and 4). An end portion of the front ceiling plate 34 is brought into contact with the upper edge of the second front side plate 33B to engage the front locking recess 36B and the front locking projection 36A to prevent the end edges of the cover support 26 from opening.

The resilient contact pieces 40 are cantilevered from the front edge of the base 25. The same number of resilient contact pieces 40 (four in this embodiment) are provided substantially side by side at the ceiling plate 29 and the bottom plate 27. Intervals between axis lines of the resilient contact pieces 40 are substantially constant in the width direction of the base 25. The resilient contact pieces 40 at the ceiling plate 29 and at the bottom plate 27 are spaced at substantially the same intervals and vertically face each other. Additionally, the opposed resilient contact pieces 40 have substantially the same size and shape, and are substantially vertically symmetric. Note that parts of the front end edge of the base 25 between the resilient contact pieces 40 are rounded.

The resilient contact pieces 40 extend obliquely forward and inwardly of the main portion 22 from the front end edge of the base 25. The length of the resilient contact pieces 40 is larger than the dimension of the base 25 in forward and backward directions. A tip of each resilient contact piece 40 is bent at a position before the free end to extend obliquely out (see FIG. 1). A most inwardly projecting part of each resilient contact piece 40 defines a contact 41 to be brought into contact with the tab 11. The contact 41 of the resilient contact piece 40 is closer to a vertical center of the coupling 35 than the upper or lower edge of the coupling 35 when the resilient contact piece 40 is a natural state (see FIG. 3). Further, the tip of the resilient contact piece 40 stays at a position more inward than the ceiling plate 29 or the bottom plate 27 when the resilient contact piece 40 is in the natural state and does not project from the ceiling plate 29 or the bottom plate 27 even if the resilient contact piece 40 is deformed resiliently by contact with the tab 11. A distance between the contacts 41 of the vertically facing resilient contact pieces 40 is smaller than the thickness of a flat part of the tab 11 by a specified dimension. All of the resilient contact pieces 40 have the same bent shape (cross-sectional shape), thickness and length.

The resilient contact pieces 40 located at the opposite widthwise ends of the base 25 are referred to as first resilient contact pieces 40A and those in the center are referred to as second resilient contact pieces 40B. The first resilient contact pieces 40A extend from parts 25A near the corners of the base 25 that have relatively high rigidity and are less likely to be deformed resiliently. The second resilient contact pieces 40B extend from an intermediate part 25B of the base 25 that has relatively low rigidity as compared to the corners of the base 25 and is likely to be deformed resiliently. The width of the first resilient contact pieces 40A are narrower than that of the second resilient contact pieces 40B (see FIGS. 4 and 5).

The free ends are narrower than the ends near the base 25 in all of the resilient contact pieces 40, and the widths are narrowed at a substantially fixed rate from the ends near the base 25 toward the free end sides. Thus, the rigidity of all of the resilient contact pieces 40 is reduced gradually or little by little from the base 25 toward the free ends. Further, a difference between the ends near the base 25 and the free ends of the first resilient contact pieces 40A is larger than that between the ends near the base 25 and the free ends of the second resilient contact pieces 40B. Specifically, the width of the first resilient contact pieces 40A is 2.15 mm at ends near the base 25 and 1.85 mm near the free ends, and the width of the second resilient contact pieces 40B is 2.5 mm at ends near the base 25 and 2.45 mm near the free ends.

Figure 6:
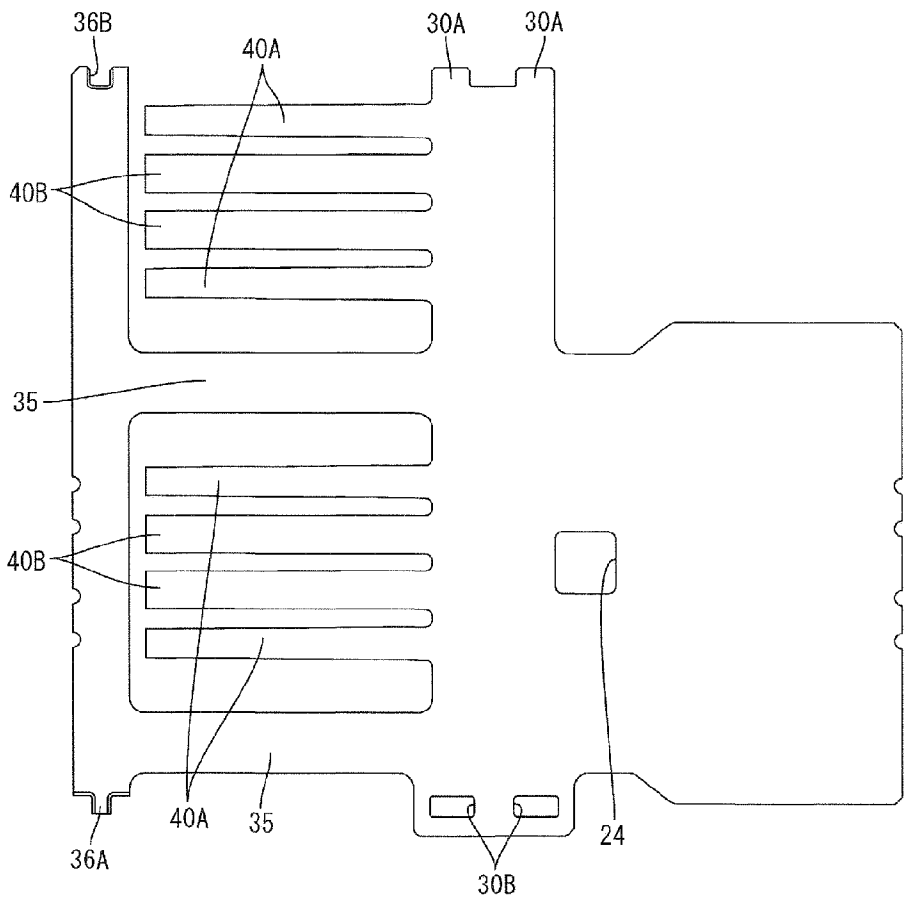
FIG. 6 is a development view of the female terminal fitting.
Figure 7:
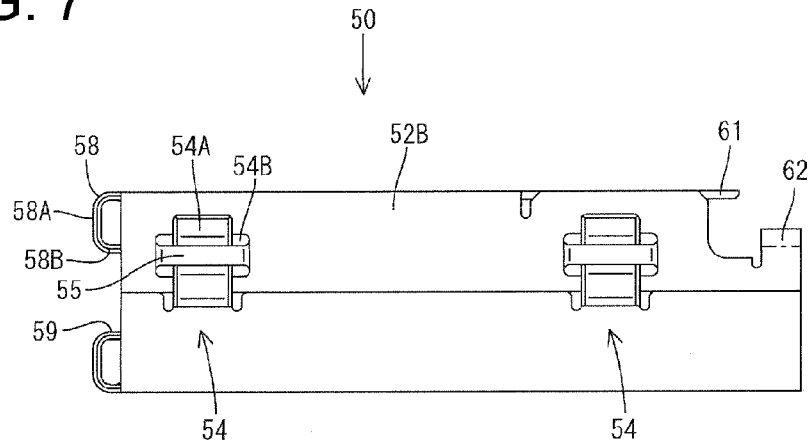
FIG. 7 is a side view of a cover.
Figure 8:
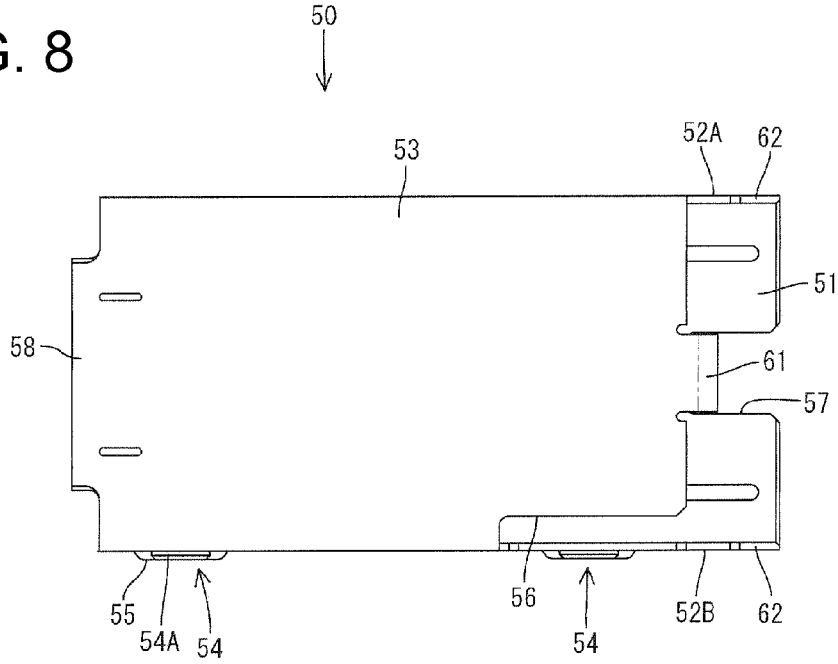
FIG. 8 is a plan view of the cover.
Figure 9:
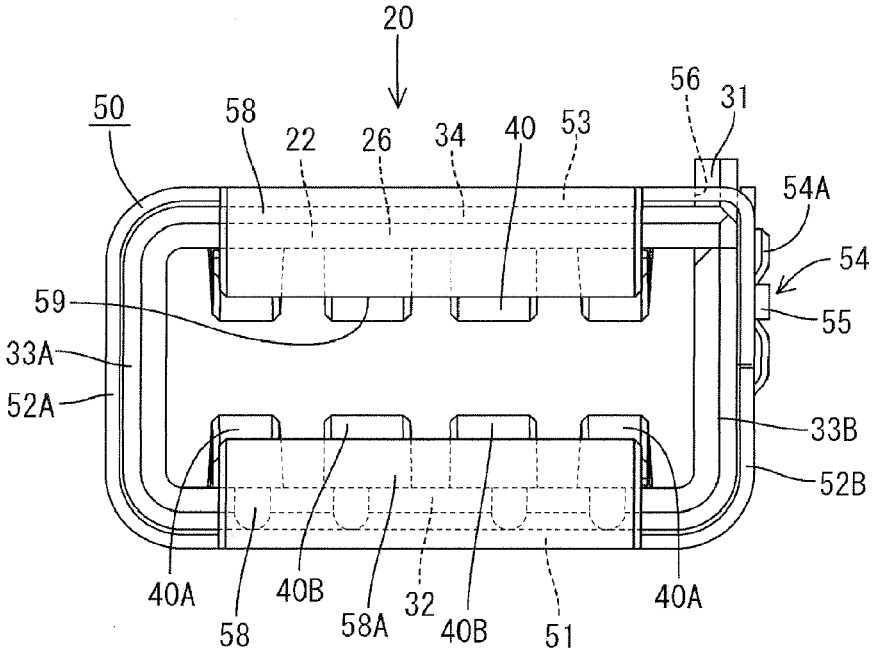
FIG. 9 is a front view of the female terminal fitting with the cover.
Figure 10:
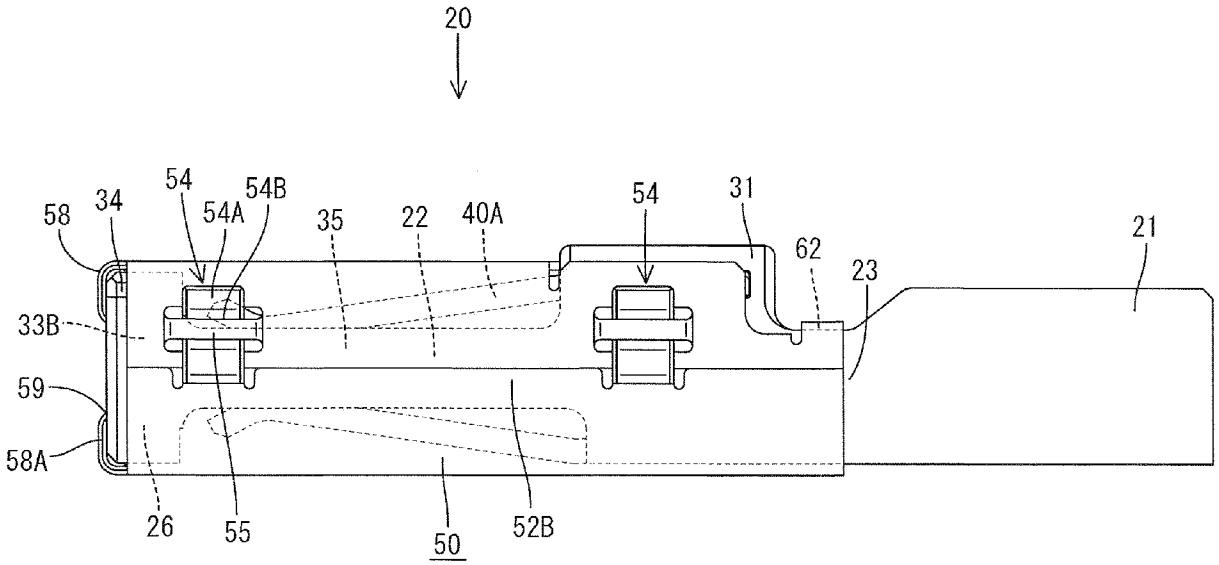
FIG. 10 is a side view of the female terminal fitting with the cover.

The female terminal fitting 20 as described above is formed to have a specified shape by punching out or cutting a conductive metal plate into a development shape as shown in FIG. 6 by a press forming machine and performing a bending process.

The cover 50 is formed by bending an electrically conductive metal plate punched out or cut into a specified shape and folding into a substantially flat rectangular tube that can accommodate the main portion 22 of the female terminal fitting 20. End edges of the cover 50 are locked to each other to prevent opening. The cover 50 includes a lower plate 51, first and second vertical plates 52A, 52B that project up from opposite sides of the lower plate 51, and an upper plate 53 bent at the upper end of the first vertical plate 52A to extend to the upper end of the second vertical plate 52B substantially parallel to the lower plate 51 (see FIG. 9). The lower plate 51 of the cover 50 is held in contact with the front bottom plate 32 of the cover support 26 and the bottom plate 27 of the base 25 of the female terminal fitting 20, the vertical plates 52A, 52B are held in contact with the front side plates 33A, 33B of the cover support 26 and the sides 28A, 28B of the base 25 of the female terminal fitting 20, and the upper plate 53 is held in contact with the front ceiling plate 34 of the cover support 26 and the ceiling plate 29 of the base 25 of the female terminal fitting 20. End edges of the cover 50 butt against each other to prevent opening at a vertical intermediate position of the other vertical plate 52B (see FIG. 10).

The cover 50 includes cover locks 54 for locking the end edges of the cover 50 to prevent opening. Each cover lock 54 has a cover locking projection 54A and a cover locking recess 54B provided one above the other at the opposite sides of the end edges of the cover 50. The cover locks 54 are provided at positions near the front and rear ends of the cover 50. Each cover locking recess 54B is formed by providing the other vertical plate 52B with a catch 55 separated outward from the other part. The catch 55 is formed by separating the upper and lower end edges from the other part. Each cover locking projection 54A is cantilevered up. The end edges of upper and lower parts of the second vertical plate 52A are brought into contact with each other and then the cover locking projections 54A are inserted into the cover locking recesses 54B from below. The catches 55 then are pressed in to dent intermediate parts of the cover locking projections 54A. This crimped engagement of the cover locking projections 54A and the cover locking recesses 54B prevents the end edges of the cover 50 from opening.

Figure 13:
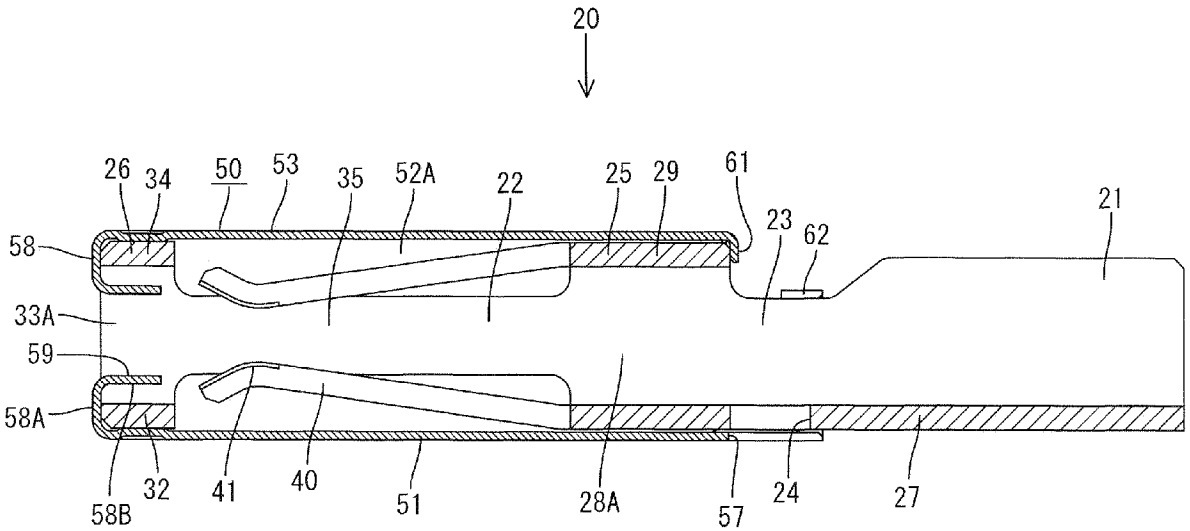
FIG. 13 is a section of the female terminal fitting with the cover.

The cover 50 extends from the front end of the main portion 22 to the coupling 23 (see FIG. 13). Specifically, the upper plate 53 of the cover 50 extends to the rear end of the main portion 22 and the lower plate 51 of the cover 50 project more back than the upper plate 53 and reaches the coupling 23. The rear end of the lower plate 51 is slightly behind the lance hole 24. Further, upper parts of rear end portions of the vertical plates 52A, 52B are cut off to the rear end of the upper plate 53 and lower parts thereof project up to the rear end of the lower plate 51 (see FIG. 10).

Figure 11:
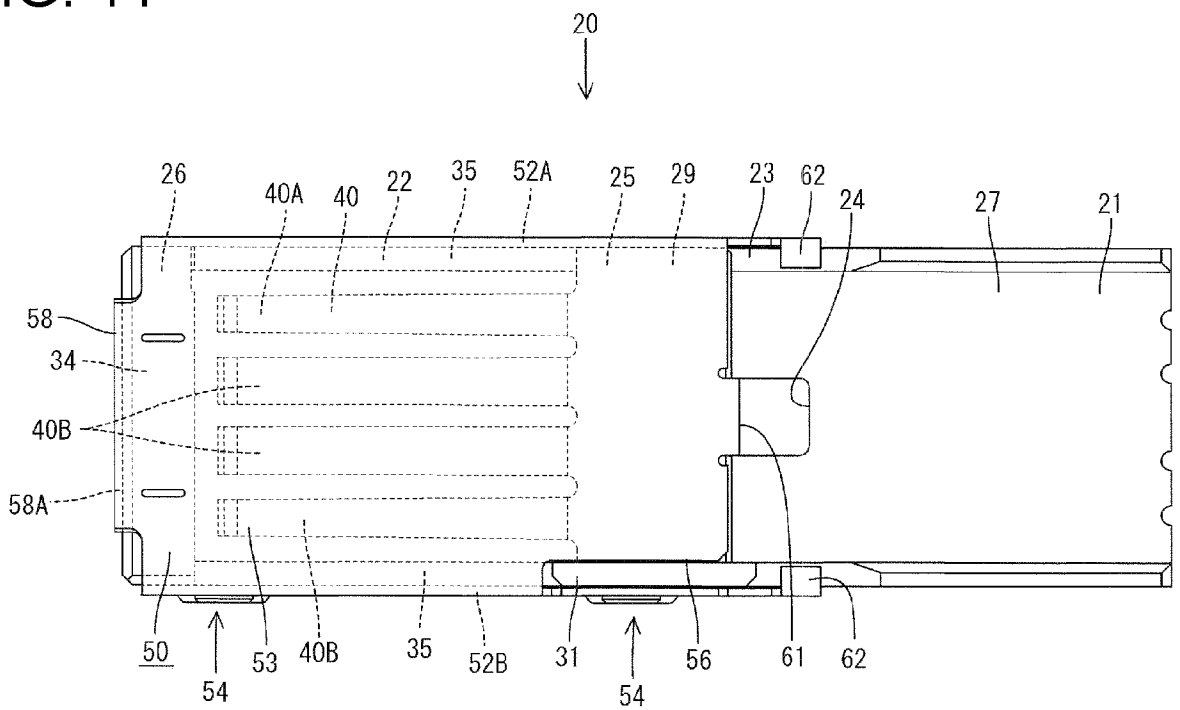
FIG. 11 is a plan view of the female terminal fitting with the cover.
Figure 12:
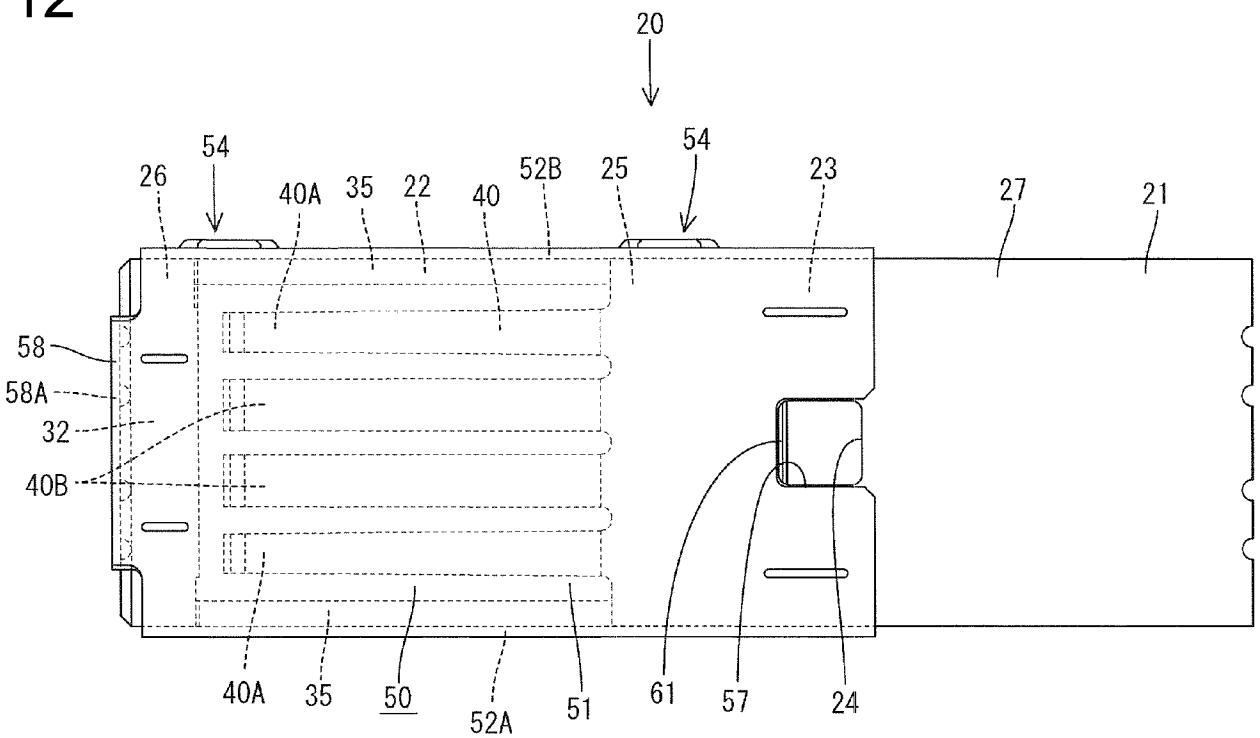
FIG. 12 is a bottom view of the female terminal fitting with the cover.

The upper plate 53 of the cover 50 is formed with a first escaping portion 56 for allowing the stabilizer 31 to escape (see FIG. 11). The first escaping portion 56 is cut forward from the rear end of the upper plate 53. Further, the lower plate 51 of the cover 50 is formed with a second escaping portion 57 for exposing the lance hole 24 of the female terminal fitting 20 (see FIG. 12). The second escaping portion 57 is a substantially rectangular cutout formed in a rear end of the lower plate 51 to open rearward and is slightly larger than the lance hole 24.

Front stops 58 are provided at the front end of the cover 50 for preventing the female terminal fitting 20 from coming out forward. The front stops 58 project forward from the front end edges of the upper and lower plates 53 and 51 and are folded in (see FIGS. 7 and 8). Each front stop 58 includes a front wall 58A substantially perpendicular to the upper or lower plate 53 or 51, and an inner wall 58B substantially parallel to the upper or lower plate 53 or 51. The front edge of the cover support 26 of the female terminal fitting 20 contacts the front walls 58A of the front stops 58, and a part between the inner walls 58B of the front stops 58 defines a tab insertion opening 59 through which the tab 11 of the male terminal fitting 10 is inserted (see FIG. 1). The tab 11 is inserted into the female terminal fitting 20 while being held in contact with the inner walls 58B.

A rear stop 61 is provided at a rear end of the cover 50 for preventing the female terminal fitting 20 from coming out backward. The rear stop 61 projects from the rear end of the upper plate 53 of the cover 50 (see FIGS. 7 and 8) in a widthwise intermediate position and has a wide rectangular shape and a longitudinal dimension equal to the width of the lance hole 24 of the female terminal fitting 20. The rear stop 61 is bent along the rear end edge of the ceiling plate 29 of the base 25 of the female terminal fitting 20 substantially perpendicular to the upper plate 53 after the cover 50 is mounted on the female terminal fitting 20 (see FIG. 13).

Pressing portions 62 extend from the upper end edges of the vertical plates 52A, 52B at the rear end of the cover 50 and press the coupling 23 of the female terminal fitting 20 from above to prevent an upward movement of the female terminal fitting 20. The pressing portions 62 are rectangles that are slightly longer in forward and backward directions, and are bent along the upper end edges of the side plates 28A, 28B of the coupling 23 in a direction substantially perpendicular to the vertical plates 52A, 52B after the cover 50 is mounted on the female terminal fitting 20.

The tab 11 of the male terminal fitting 10 is inserted into the main portion 22 of the female terminal fitting 20 through the tab insertion opening 59 of the cover 50. The tab 11 thrusts itself between the upper and lower contact portions 41 while resiliently displacing the resilient contact pieces 40 out and is sandwiched resiliently between the contacts 41 when inserted by a proper amount to connect the male and female terminal fittings 10, 20 electrically. At this time, contact pressures acting from the first and second resilient contact pieces 40A, 40B on the tab 11 are substantially equal.

The resilient contact pieces 40 extend from the substantially rectangular tubular base 25 of the multi-contact terminal fitting T and are brought into contact with the outer peripheral surface of the tab 11 of the male terminal fitting 10. The first resilient contact pieces 40A extending from the areas 25A of the base 25 having relatively high rigidity are narrower and the second resilient contact pieces 40B extending from the areas 25B of the base 25 having relatively low rigidity are wider.

In this way, the rigidity of the first resilient contact pieces 40A having high rigidity at their base end parts becomes relatively low and that of the second resilient contact pieces 40B having low rigidity at their base end parts becomes relatively high, wherefore contact pressures acting from all the resilient contact pieces 40 on the tab 11 particularly can be made substantially equal or the contact pressure difference thereof can be reduced. Further, since the tab 11 of the male terminal fitting 10 particularly can be formed by pressing work, it can be inexpensively produced as compared with the case where it is a round pin which requires cutting work. That is, according to the construction of this embodiment, the multi-contact terminal fitting T can be inexpensively produced and contact pressures of all the resilient contact pieces 40 can be made equal.

All of the resilient contact pieces have the same width in the conventional technology. Thus, contact pressures on the tab 11 differ between the resilient contact pieces that have relatively high rigidity at base ends and those having relatively low rigidity at base ends. In such a case, the widths of all of the resilient contact pieces must be set as to ensure a minimum necessary contact pressure for the resilient contact pieces that have a low contact pressure. In this situation, the total contact pressure of all of the resilient contact pieces becomes excessive, leading to a problem of increasing a connection force necessary to connect the male terminal fitting 10 and the female terminal fitting 20. However, the contact pressures of all of the resilient contact pieces 40 of the multi-contact terminal fitting T of this embodiment can be made substantially equal. Therefore, the connection force for connecting the male and female terminal fittings 10 and 20 is low.

The base 25 of the female terminal fitting 20 is folded into a substantially rectangular tube and the end edges are locked together to prevent opening. Thus, contact pressures of the resilient contact pieces 40 are not reduced due to the opening of the base 25 and a predetermined contact pressure can be ensured.

Further, the cover 50 is mounted on the female terminal fitting 20 and at least partly covers and protects all of the resilient contact pieces 40.

The resilient contact pieces 40 are cantilevered from the base 25. The cover support 26 is located outward of the free ends of the resilient contact pieces 40 for contacting the inner side of the cover 50. Thus, the cover support 26 prevents the cover 50 from contacting the resilient contact pieces 40.

The invention is not limited to the above described embodiment. For example, the following embodiments are also included in the scope of the invention.

Although the resilient contact pieces 40 are cantilevered from the base 25 in the above embodiment, they may be supported at both ends.

First and second resilient contact pieces 40A and 40B of different widths are provided in the above embodiment. However, the resilient contact pieces 40 may have at least three different widths. For example, if five resilient contact pieces are arranged in the width direction, two first resilient contact pieces at the opposite ends, two second resilient contact pieces inward of the first resilient contact pieces and one third resilient contact piece in the center may have different widths in a stepwise manner.

The resilient contact pieces 40 are provided only at the ceiling plate 29 and the bottom plate 27 of the base 25 in the above embodiment. However, resilient contact pieces may be provided also at the side plates. In such a case, the widths of the resilient contact pieces including those at the side plates may be set arbitrarily.

Opening of the end edges of the base 25 of the female terminal fitting 20 in the folding direction is prevented by the locks 30 in the above embodiment. However, such a measure to prevent opening may not be provided or an alternate measure, such as soldering or welding may be provided.

The parts near the corners of the base 25 have relatively high rigidity and the intermediate parts have relatively low rigidity in the above embodiment. However, the corner parts may not always be more rigid than high the middle parts since relative rigidity of the base is determined by the shape of the base and the like. For example, the corners may be less rigid than the intermediate parts due to openings near the corners of the base. Thus, in some situations it is better to make the widths of the resilient contact pieces extending from the intermediate parts smaller than widths of the resilient contact pieces extending from the corners.

The resilient contact pieces 40 are narrower at the free ends than at ends near the base 25 in the above embodiment. However, the resilient contact pieces 40 may have constant widths over the entire lengths or may be wider at the free ends may. The widths of the resilient contact pieces 40 are reduced at a fixed rate from the ends near the base 25 to the free ends in the above embodiment. However, the resilient contact pieces may include both a part whose width changes at a fixed rate and a part whose width does not change.

What is claimed is:

1. A multi-contact terminal fitting, comprising:

a base with at least one first part having high rigidity and at least one second part having low rigidity; and first and second resilient contact pieces independently cantilevered from the first and second parts of the base respectively and being configured to be brought into contact with an outer peripheral surface of a tab of a mating terminal fitting, the first resilient contact pieces being narrower than the second resilient contact pieces by an amount to achieve a sufficiently lower rigidity for the first resilient contact pieces as compared to the second resilient contact pieces to offset the high rigidity of the first part of the base so that the first and second resilient contact pieces exert substantially equal contact pressures.

2. The multi-contact terminal fitting of claim 1, wherein the base is a substantially rectangular or polygonal tube.

3. The multi-contact terminal fitting of claim 2, wherein the base has side edges locked together to prevent opening of the rectangular or polygonal tube.

4. The multi-contact terminal fitting of claim 1, further comprising a cover for at least partly covering the resilient contact pieces.

5. The multi-contact terminal fitting of claim 4, wherein the cover has at least one inner wall disposed for contacting the tab inserted into the female terminal fitting.

6. The multi-contact terminal fitting of claim 4, wherein the resilient contact pieces are cantilevered from the base, the terminal fitting further including a cover support located outward of free ends of the resilient contact pieces, the cover support being in contact with an inner side of the cover.

7. The multi-contact terminal fitting of claim 6, further comprising a cover support connected to the base by means of a coupling, the cover support having a cross-sectional shape substantially conforming to a cross-sectional shape as the base and a dimension of the cover support in forward and backward directions being smaller than the base.

8. The multi-contact terminal fitting of claim 6, wherein a contact is defined at a most inward part of the resilient contact piece for contacting the tab.

9. The multi-contact terminal fitting of claim 8, wherein the contact of the resilient contact piece is located closer to a vertical center of the coupling than a lateral edge of the coupling when the resilient contact piece is in a natural state.

10. The multi-contact terminal fitting of claim 8, wherein a tip of the resilient contact piece stays at a position more inward than a ceiling plate or a bottom plate the base when the resilient contact piece is in a natural state and does not project from the ceiling plate or the bottom plate if the resilient contact piece is resiliently deformed by the contact with the tab.

11. The multi-contact terminal fitting of claim 6, wherein a difference between sides near the base and the free ends of the first resilient contact pieces is larger than that between the sides near the base and the free ends of the second resilient contact pieces.

12. The multi-contact terminal fitting of claim 6, wherein free ends of the resilient contact pieces are narrower than sides near the base, and widths are narrowed substantially at a fixed rate from the sides near the base portion toward the free ends.

13. The multi-contact terminal fitting of claim 10, wherein the contacts of the first and second resilient contact pieces in the natural state are spaced substantially equally from the ceiling plate of the base.

* * * * *